US008783764B2

(12) United States Patent
Murphy et al.

(10) Patent No.: US 8,783,764 B2
(45) Date of Patent: Jul. 22, 2014

(54) POWER-ASSISTED RECLINING LIFT CHAIR WITH SINGLE POWER ACTUATOR

(75) Inventors: Marcus L. Murphy, Lexington, NC (US); D. Stephen Hoffman, High Point, NC (US)

(73) Assignee: Ultra-Mek, Inc., Denton, NC (US)

( * ) Notice: Subject to any disclaimer, the term of this patent is extended or adjusted under 35 U.S.C. 154(b) by 808 days.

(21) Appl. No.: 12/787,595

(22) Filed: May 26, 2010

(65) Prior Publication Data

US 2011/0291460 A1 Dec. 1, 2011

(51) Int. Cl.
*A47C 1/024* (2006.01)
*A47C 1/035* (2006.01)

(52) U.S. Cl.
USPC ..... 297/71; 297/85 M; 297/344.14

(58) Field of Classification Search
USPC ..... 297/68, 71, 85 R, 85 M, 344.14
See application file for complete search history.

(56) References Cited

U.S. PATENT DOCUMENTS

| | | | | |
|---|---|---|---|---|
| 3,337,267 | A | 8/1967 | Rogers, Jr. | |
| 3,522,969 | A | 8/1970 | Re | |
| 4,007,960 | A * | 2/1977 | Gaffney | 297/71 |
| 4,212,494 | A | 7/1980 | Dabney | |
| 4,270,796 | A | 6/1981 | Preston | |
| 4,662,673 | A | 5/1987 | Crum | |
| 4,707,025 | A | 11/1987 | Rogers, Jr. | |
| 4,915,444 | A | 4/1990 | Rogers, Jr. | |
| 5,013,084 | A | 5/1991 | May | |
| 5,061,010 | A * | 10/1991 | LaPointe | 297/325 |
| 5,088,789 | A | 2/1992 | LaPointe et al. | |
| 5,368,366 | A | 11/1994 | Mizelle | |

(Continued)

*Primary Examiner* — David R Dunn
*Assistant Examiner* — Timothy J Bindley
(74) *Attorney, Agent, or Firm* — Myers Bigel Sibley & Sajovec, P.A.

(57) ABSTRACT

A seating unit includes: a base; a frame with arms on opposing sides; a seat; a backrest; at least one ottoman; a reclining mechanism, a lift mechanism and a power unit. The reclining mechanism interconnects the frame, the seat, the backrest, and the at least one ottoman, and comprises a series of pivotally interconnected links and configured to move the seating unit between (a) an upright position, in which the backrest is generally upright and defines a first backrest angle relative to horizontal, the seat is generally horizontal, and the at least one ottoman is retracted below the seat, (b) a TV position, in which the backrest substantially maintains the first backrest angle, and the at least one ottoman is extended in front of the seat, and a fully reclined position, in the at least one ottoman remains extended on front of the seat, and the backrest defines a second backrest angle relative to horizontal that is shallower than the first backrest angle. The lift mechanism interconnects the base and the frame and is configured to move the seating unit between the upright position and a lift position, in which both the frame and the seat are raised and tilted forward from their respective positions in the upright position, and the backrest defines a third backrest angle relative to horizontal that is greater than the first backrest angle. The power unit is interconnected with the reclining mechanism and the lift mechanism and is configured to move the seating unit between the lift, upright, TV and fully reclined positions. A lowermost portion of the backrest moves substantially directly vertically when moving from the upright position to the lift position. In such a configuration, the arrangement of the backrest and/or seat can provide the occupant with a more secure sensation as the chair lifts; it does not produce a sensation of the occupant being "thrown" from the chair, as can be the case with other lift chairs.

15 Claims, 10 Drawing Sheets

(56) References Cited

U.S. PATENT DOCUMENTS

| | | | | |
|---|---|---|---|---|
| 5,730,494 | A * | 3/1998 | LaPointe et al. | 297/330 |
| 6,540,291 | B2 | 4/2003 | Hoffman et al. | |
| 6,634,706 | B2 | 10/2003 | May | |
| 6,659,556 | B2 * | 12/2003 | Pellerin | 297/330 |
| 6,793,279 | B2 | 9/2004 | Hoffman et al. | |
| 6,840,575 | B2 | 1/2005 | Hesse | |
| 6,945,599 | B2 | 9/2005 | May | |
| 7,021,711 | B1 | 4/2006 | Hoffman et al. | |
| 7,357,450 | B2 | 4/2008 | Rogers | |
| 7,445,279 | B2 | 11/2008 | Crum | |
| 7,543,885 | B2 * | 6/2009 | Pollard et al. | 297/85 R |
| 7,575,279 | B2 | 8/2009 | Robertson | |

* cited by examiner

POWER-ASSISTED RECLINING LIFT CHAIR WITH SINGLE POWER ACTUATOR

FIELD OF THE INVENTION

The present invention is directed generally to lift chairs, and more particularly to lift chairs having reclining capability.

BACKGROUND OF THE INVENTION

Conventionally, power-assisted chairs typically include a motor-operated lift mechanism for aiding invalids and those persons requiring assistance in entering or exiting the chair. More particularly, motor-operated lift mechanisms are interconnected between a stationary base assembly and a moveable chair frame. An example of such a power-assisted chair is disclosed in U.S. Pat. No. 4,993,777 to LaPointe.

Some power-assisted chairs also include separate linkage mechanisms for permitting the seat occupant to selectively actuate an extensible leg rest assembly and/or produce reclining angular movement of a seat assembly between "upright" and "reclined" positions. However, many power-assisted chairs which provide such a multi-functional combination require the use of multiple motors for driving (i.e., pushing) the separate linkages which results in extremely large and expensive chair units yet still having limited reclining options. Moreover, such power-assisted chairs typically incorporate a drive mechanism which employs both a power "drive" function (i.e., for extending the leg rest, lifting the chair, and/or reclining the chair) and a power "return" function for returning the chair to the normal seated position.

One power-assisted lift chair that employs a single actuator is disclosed in U.S. Pat. No. 5,730,494 to LaPointe et al. This chair employs a linear actuator with a carrier, wherein the carrier moves rearwardly relative to the base to lift the chair from its upright position. The carrier moves forwardly to move the chair from its upright position to its TV and fully reclined positions.

Those skilled in this art will appreciate that additional chair designs with improved functionality may be desirable.

SUMMARY OF THE INVENTION

As a first aspect, embodiments of the present invention are directed to a seating unit. The seating unit comprises: a base; a frame with arms on opposing sides; a seat; a backrest; at least one ottoman; a reclining mechanism, a lift mechanism and a power unit. The reclining mechanism interconnects the frame, the seat, the backrest, and the at least one ottoman, and comprises a series of pivotally interconnected links and configured to move the seating unit between (a) an upright position, in which the backrest is generally upright and defines a first backrest angle relative to horizontal, the seat is generally horizontal, and the at least one ottoman is retracted below the seat, (b) a TV position, in which the backrest substantially maintains the first backrest angle, and the at least one ottoman is extended in front of the seat, and (c) a fully reclined position, in the at least one ottoman remains extended on front of the seat, and the backrest defines a second backrest angle relative to horizontal that is shallower than the first backrest angle. The lift mechanism interconnects the base and the frame and is configured to move the seating unit between the upright position and a lift position, in which both the frame and the seat are raised and tilted forward from their respective positions in the upright position, and the backrest defines a third backrest angle relative to horizontal that is greater than the first backrest angle. The power unit is interconnected with the reclining mechanism and the lift mechanism and is configured to move the seating unit between the lift, upright, TV and fully reclined positions. A lowermost portion of the backrest moves substantially directly vertically when moving from the upright position to the lift position. In such a configuration, the arrangement of the backrest and/or seat can provide the occupant with a more secure sensation as the chair lifts; it does not produce a sensation of the occupant being "thrown" from the chair, as can be the case with other lift chairs.

As a second aspect, embodiments of the present invention are directed to a seating unit comprising: a base; a frame with arms on opposing sides; a seat; a backrest; at least one ottoman; a reclining mechanism; a lift mechanism; and a power unit. The reclining mechanism interconnects the frame, the seat, the backrest, and the at least one ottoman and comprises a series of pivotally interconnected links and configured to move the seating unit between (a) an upright position, in which the backrest is generally upright and defines a first backrest angle relative to horizontal, the seat is generally horizontal, and the at least one ottoman is retracted below the seat, (b) a TV position, in which the backrest substantially maintains the first backrest angle, and the at least one ottoman is extended in front of the seat, and (c) a fully reclined position, in the at least one ottoman remains extended on front of the seat, and the backrest defines a second backrest angle relative to horizontal that is shallower than the first backrest angle. The lift mechanism interconnects the base and the frame and is configured to move the seating unit between the upright position and a lift position, in which both the frame and the seat are raised and tilted forward from their respective positions in the upright position, and the backrest defines a third backrest angle relative to horizontal that is greater than the first backrest angle. The power unit is interconnected with the reclining mechanism and the lift mechanism and is configured to move the seating unit between the lift, upright, TV and fully reclined positions. The seat defines a first seat angle in the upright position and a second seat angle in the lift position, and the difference between the first and second seat angles is between about 13 and 21 degrees.

DETAILED DESCRIPTION OF EMBODIMENTS OF THE INVENTION

Figure 1:
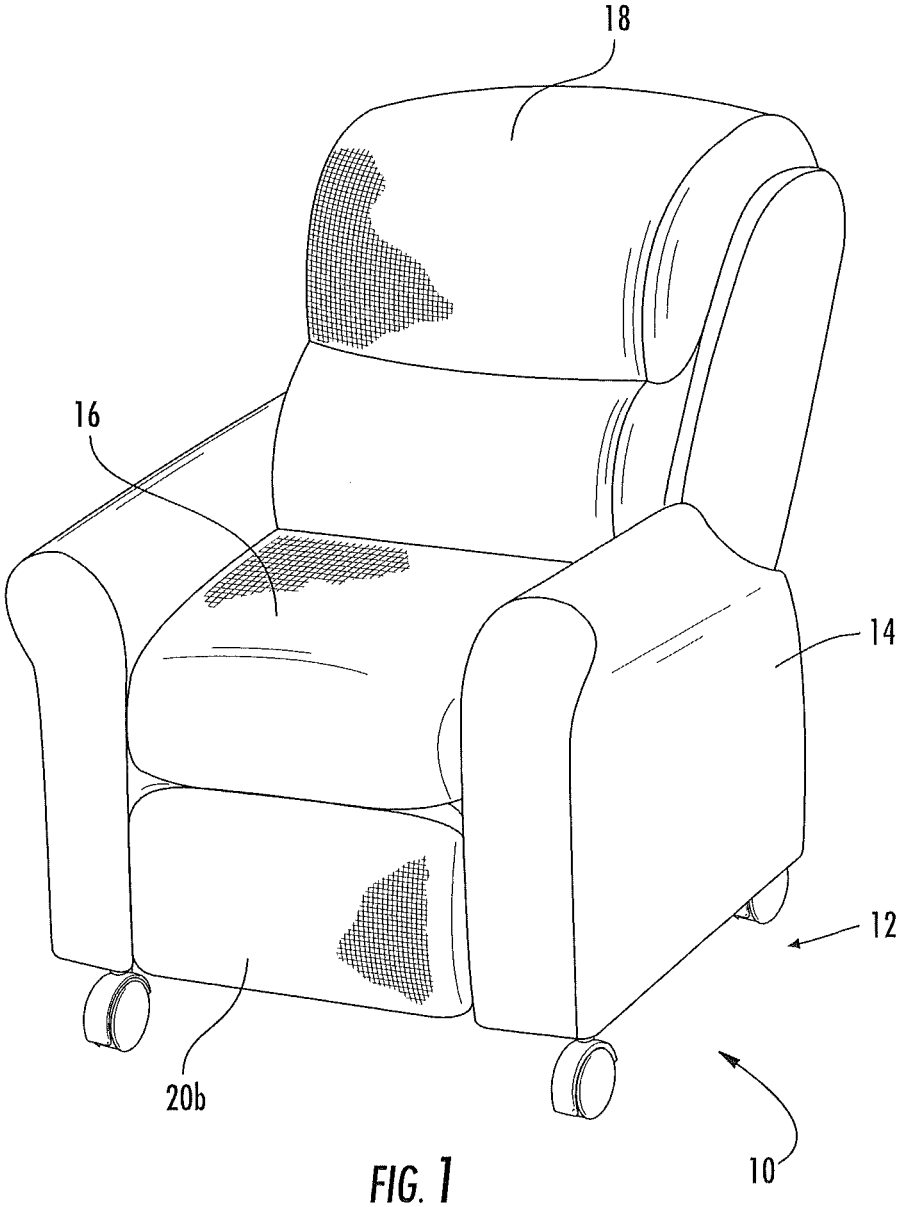
FIG. 1 is a perspective view of a reclining lift chair according to embodiments of the present invention.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity. Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

This invention is directed to seating units that have a stationary base, a seat portion, and a backrest. As used herein, the terms "forward", "forwardly", and "front" and derivatives thereof refer to the direction defined by a vector extending from the backrest toward the seat parallel to the underlying surface. Conversely, the terms "rearward", "rearwardly", and derivatives thereof refer to the direction directly opposite the forward direction; the rearward direction is defined by a vector that extends from the seat toward the backrest parallel to the underlying surface. The terms "lateral," "laterally", and derivatives thereof refer to the direction parallel with the floor, perpendicular to the forward and rearward directions, and extending away from a plane bisecting the seating units between their armrests. The terms "medial," "inward," "inboard," and derivatives thereof refer to the direction that is the converse of the lateral direction, i.e., the direction parallel with the floor, perpendicular to the forward direction, and extending from the periphery of the seating units toward the aforementioned bisecting plane.

The seating units illustrated and described herein comprise a plurality of pivotally interconnected links. Those skilled in this art will appreciate that the pivots between links can take a variety of configurations, such as pivot pins, rivets, bolt and nut combinations, and the like, any of which would be suitable for use with the present invention. Also, the shapes of the links may vary as desired, as may the locations of certain of the pivots. Moreover, in some instances combinations of pivot points may be replaced by equivalent structures, such as "slider-crank" configurations, like those described in B. Paul, *Kinematics and Dynamics of Planar Machinery* 4-21 (1979).

Referring now to the figures, a reclining lift chair, designated broadly at 10, is illustrated in FIG. 1. The chair includes a base 12 that rests on an underlying surface, a frame 14, a seat 16, a backrest 18, and rear, main, and front ottomans 20*a*, 20*b*, 20*c* (only the main ottoman 20*b* is visible in FIG. 1). These structures are interconnected with a pair of reclining mechanisms 21 and a lift mechanism 23 (see FIG. 4). These components are discussed in greater detail below.

Figure 5:
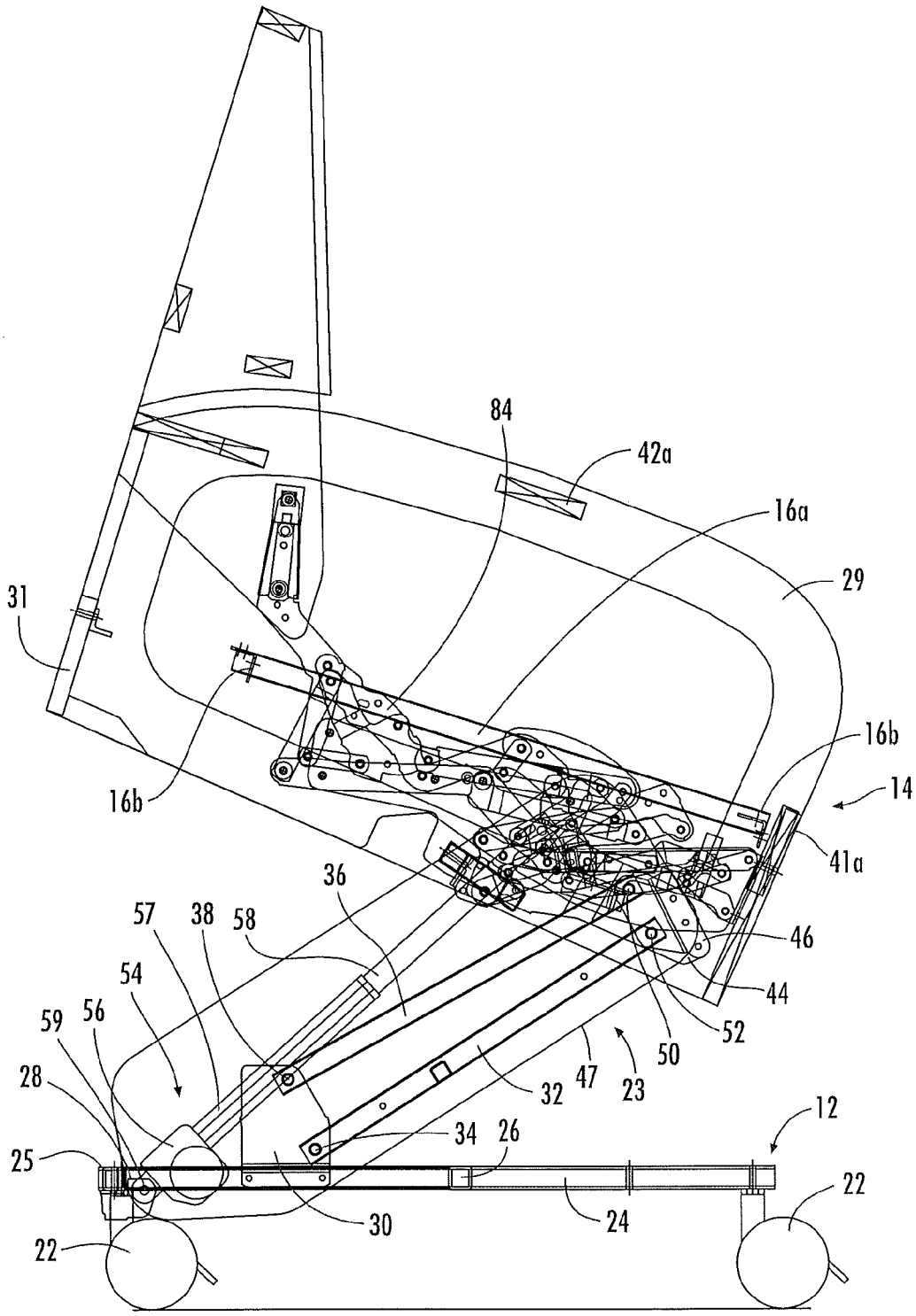
FIG. 5 is a cutaway side view of the chair of FIG. 1, with the chair in its lift position.
Figure 5A:
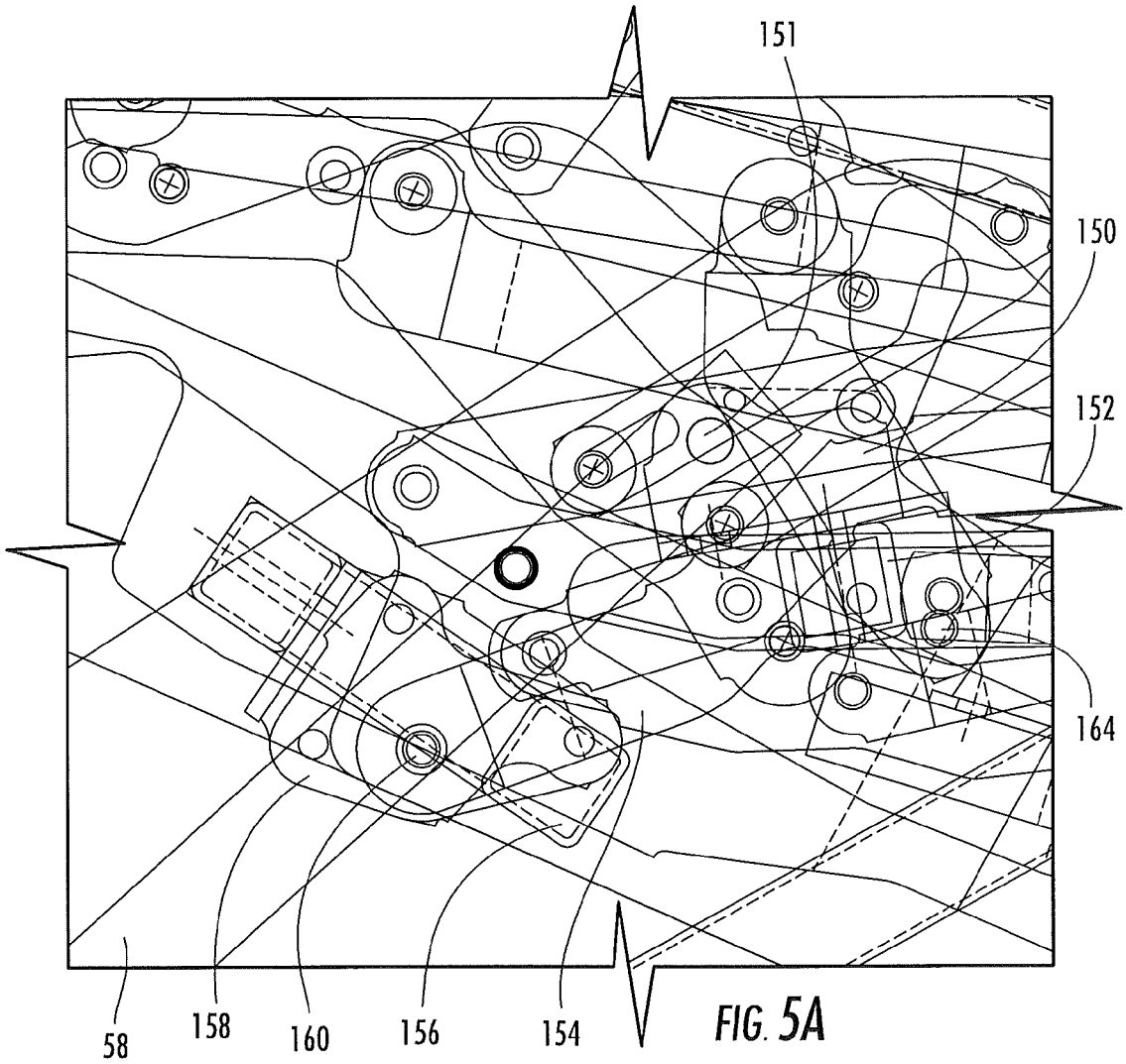
Figure 6:
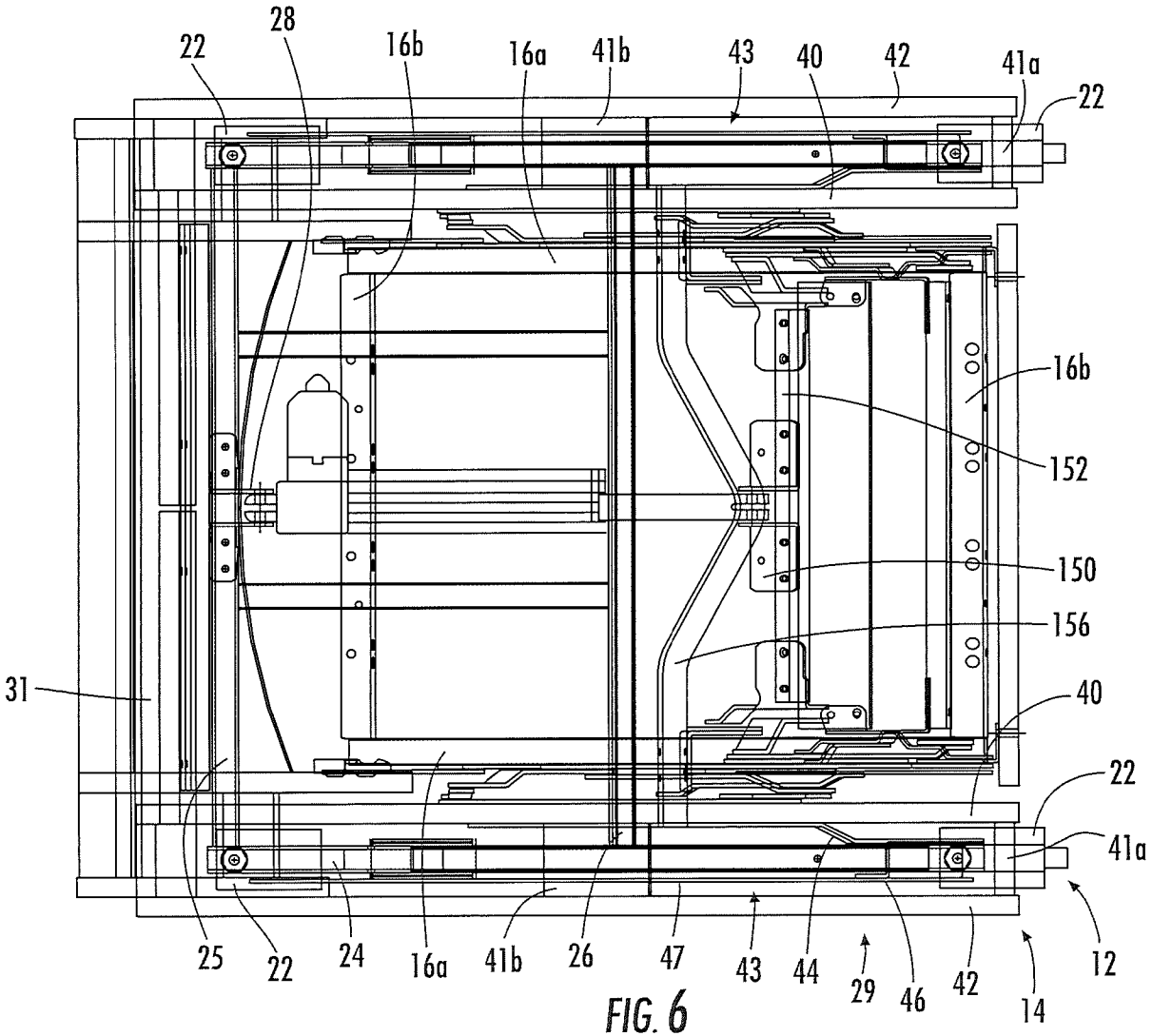
FIG. 6 is a cutaway top view of the chair of FIG. 1, with the chair in its upright position.

Referring now to FIGS. 5 and 6, the base 12 includes a pair of side rails 24 and a pair of cross-members 25, 26 that extend between the side rails 24. Two casters 22 are mounted to the underside of each side rail 24. An actuator mounting bracket 28 is mounted to the rear cross-member 25.

The frame 14 includes arms 29 and a rear panel 31 that spans the arms 29. Each arm 29 comprises an inner panel 40 and an outer panel 42 that are separated by spacers 41*a*, 41*b*, thereby forming a cavity 43 within each arm 29.

Still referring to FIGS. 5 and 6, the seat 16 includes side rails 16*a* and cross-members 16*b*, which combine to form a generally square structure. A cushion (shown in FIG. 1) rests on the side rails 16*a* and cross-members 16*b*. A seat panel 84 is mounted to the outside of each side rail 16*a*.

The lift mechanism 23 is configured to move the chair 10 between an upright position (shown in FIG. 2), in which the backrest 18 is generally upright and defines a first backrest angle relative to horizontal, the seat 16 is generally horizontal, and the ottomans 20*a*, 20*b*, 20*c* are retracted below the seat 16, and a lift position (FIG. 5), in which both the frame 14 and the seat 16 are raised and tilted forward from their respective positions in the upright position, and the backrest 18 defines a third backrest angle relative to horizontal that is greater than the first backrest angle. For clarity, the lift mechanism 23 will be described first with respect to the lift position (FIG. 5).

Referring now to FIG. 5, the lift mechanism 23 includes an actuator 54 that is pivotally mounted to the actuator mounting bracket 28 at a pivot 59. The actuator 54 includes a motor 56, a sleeve 57 that extends forwardly and upwardly from the motor 56, and a rod 58 that is retractable into and extendable away from the sleeve 57.

A lift mounting plate 44 is mounted to the outer surface of the inner arm panel 40. A lift mounting bracket 46 is fixed to the outer surface of the lift mounting plate 44 and extends laterally therefrom. A lift link mounting bracket 30 is mounted on a side rail 24 of the base 12 forwardly of the cross-member 25 and extends upwardly therefrom.

A rear lift link 36 is pivotally mounted to the lift link mounting bracket 30 at a pivot 38. A front lift link 32 is pivotally mounted to the lift link mounting bracket 30 at a pivot 34. Each of the front and rear lift links 32, 36 extends upwardly and forwardly from its respective pivot 34, 38 to a respective pivot 50, 52 with the lift mounting bracket 46. A cover 47 shields the lift links 32, 36 from the outside.

Figure 4:
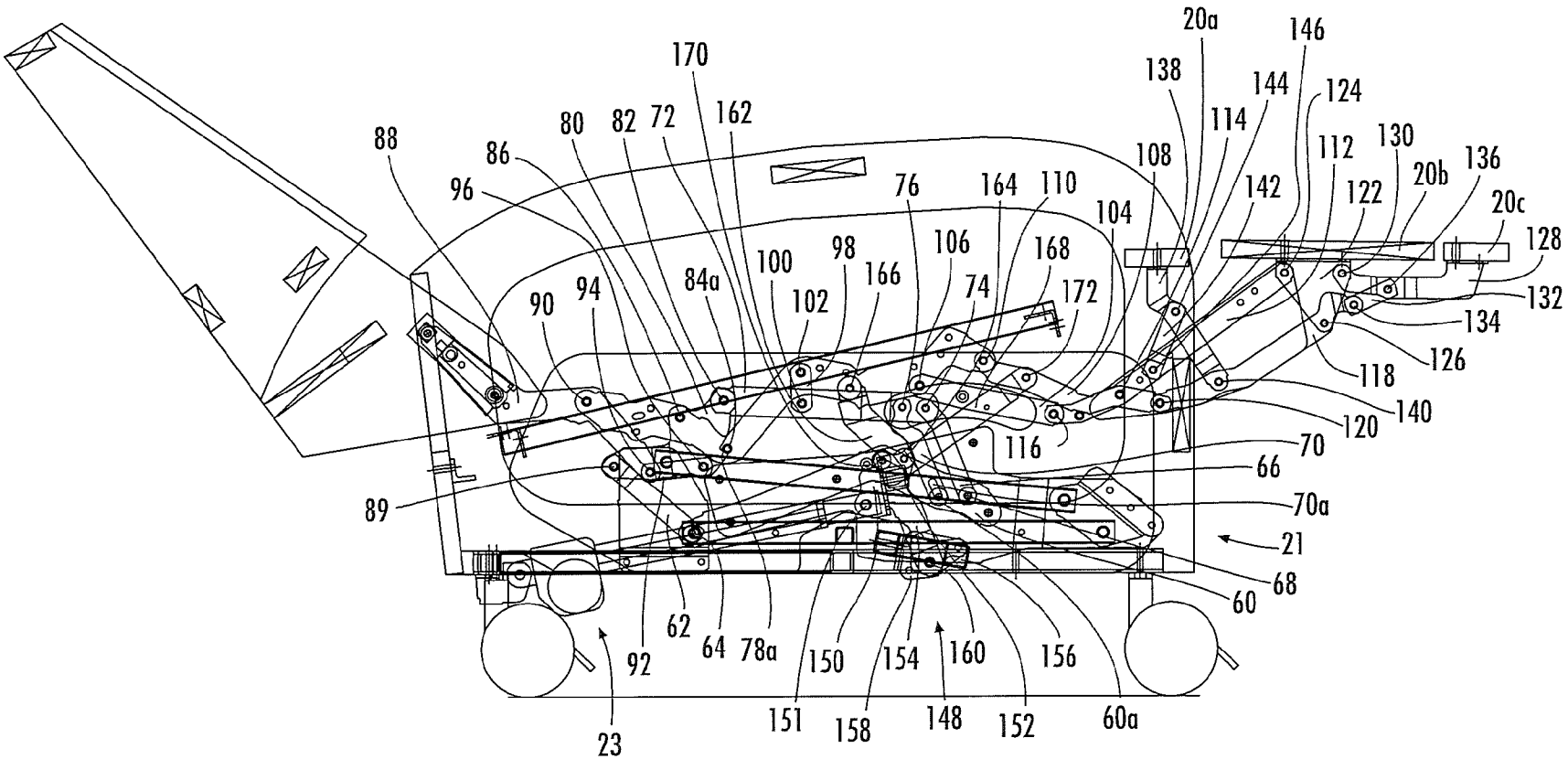
FIG. 4 is a cutaway side view of the chair of FIG. 1, with the chair in its fully reclined position.
Figure 4A:
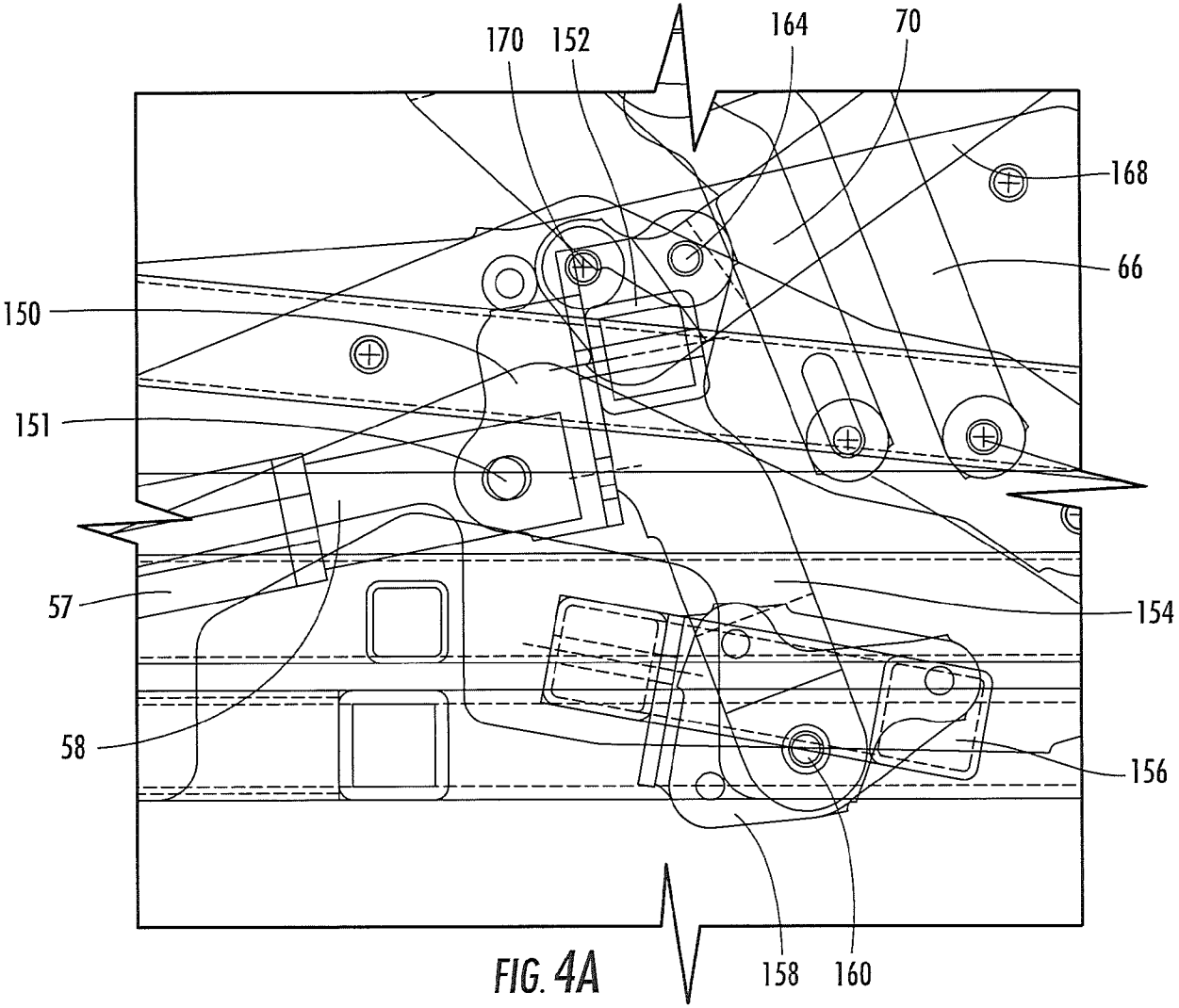

Referring now to FIGS. 4 and 6 for clarity, a drive linkage 148 includes an actuator rod bracket 150 to which the rod 58 of the actuator 54 is attached at a pivot 151. The actuator rod bracket 150 is mounted on a cross-member 152 that extends transversely across the chair 10. A transition link 154 is fixed to the cross-member 152. A bent cross-member 156 is fixed to and extends between the inner arm panels 40. A multi-piece side mounting bracket 158 is fixed to the cross-member 152. The transition link 154 is attached to the side mounting bracket 158 at a pivot 160. A tying link 162 is attached to the opposite end of the transition link 154 at a pivot 164 and to the seat panel 84 at a pivot 166.

Turning now to the reclining mechanism 21, each of the reclining mechanisms 21 is a mirror image of the other reclining mechanism about a vertical plane that extends from the front of the chair 10 to the rear centered between the arms 29. In the interest of brevity, only one reclining mechanism 21 will be described herein, with the understanding that the discussion is equally applicable to the other reclining mechanism 21. Also, the reclining mechanism will be described first with respect to the fully reclined position (FIG. 4) in order to illustrate more easily the interconnection of the various links thereof.

Referring still to FIG. 4, the reclining mechanism 21 has an angled frame bracket 60 mounted to the inner surface of the inner arm panel 40. A rear swing link 62 is attached at its lower end to the frame bracket 60 at a pivot 64 and extends upwardly and rearwardly therefrom. A front swing link 66 is attached at its lower end to the frame bracket 60 at a pivot 68 and extends upwardly and slightly rearwardly therefrom. A sequencer link 70 is attached to the frame bracket 60 via slot 70*a* that receives a pin 60*a* on the frame bracket 60. The sequencer link 70 extends upwardly and rearwardly to attach to a connector link 72 at a pivot 76; the front swing link 66 also attaches to the connector link 72 at a pivot 74. The connector link 72 extends substantially rearwardly from the pivot 76 to a pivot 82 with a transition plate 80. The transition plate 80, which has three fingers, is attached by its middle finger to the seat panel 84 at a pivot 86, and is also attached at its rear finger with the upper end of the rear swing link 62 at a pivot 89. A control link 98 is attached to the seat panel 84 at a pivot 102 and to the connector link 72 at a pivot 100.

Still referring to FIG. 4, a tripartite backpost 88 is fixed to the backrest 18 and extends downwardly and forwardly therefrom. At one of its interior vertices, the backpost 88 is attached to the seat panel 84 at a pivot 90. A drive link 92 is attached to the lower, forward end of the backpost 88 at a pivot 94 and extends forwardly therefrom to a pivot 96 with the lower portion of the transition plate 80.

Referring still to FIG. 4, a rear ottoman drive link 104 is attached at a pivot 106 to the seat panel 84 and extends forwardly therefrom. A front ottoman drive link 108 is attached at a pivot 110 to the seat panel 84 at a pivot that is positioned forwardly and upwardly from the pivot 106. A rear ottoman extension link 112 is attached to the forward end of the rear ottoman drive link 104 at a pivot 116 and extends forwardly and upwardly therefrom; the rear ottoman extension link 112 is also attached to an intermediate section of the front ottoman drive link 108 at a pivot 114. A front ottoman extension link 118 is attached at its rear end to the front end of the front ottoman drive link 108 at a pivot 120 and extends forwardly and upwardly therefrom generally parallel with the rear ottoman drive link 112. A main ottoman bracket 122, to which the main ottoman 20*b* is mounted, is attached to the forward ends of the rear ottoman drive link 112 and the front ottoman drive link 118 at, respectively, pivots 124 and 126.

Referring once again to FIG. 4, a front ottoman bracket 128 is attached to the main ottoman bracket 122 at a pivot 130 and extends forwardly therefrom. The front ottoman 20*c* is mounted to the forward end of the front ottoman bracket 128. A control link 132 extends between a pivot 134 with the front ottoman extension link 118 and a pivot 136 with the front ottoman bracket 128. A rear ottoman bracket 138 is attached to the front ottoman extension link 118 at a pivot 140 and extends upwardly and rearwardly to support the rear ottoman 20*a* mounted thereon. A bracing link 142 extends between a pivot 144 with the rear ottoman extension link 112 and a pivot 146 with the rear ottoman bracket 138.

A drive link 168 is attached to the front ottoman drive link 108 at a pivot 172, and extends rearwardly therefrom to a pivot 170 with the frame mounting bracket 60.

Figure 2:
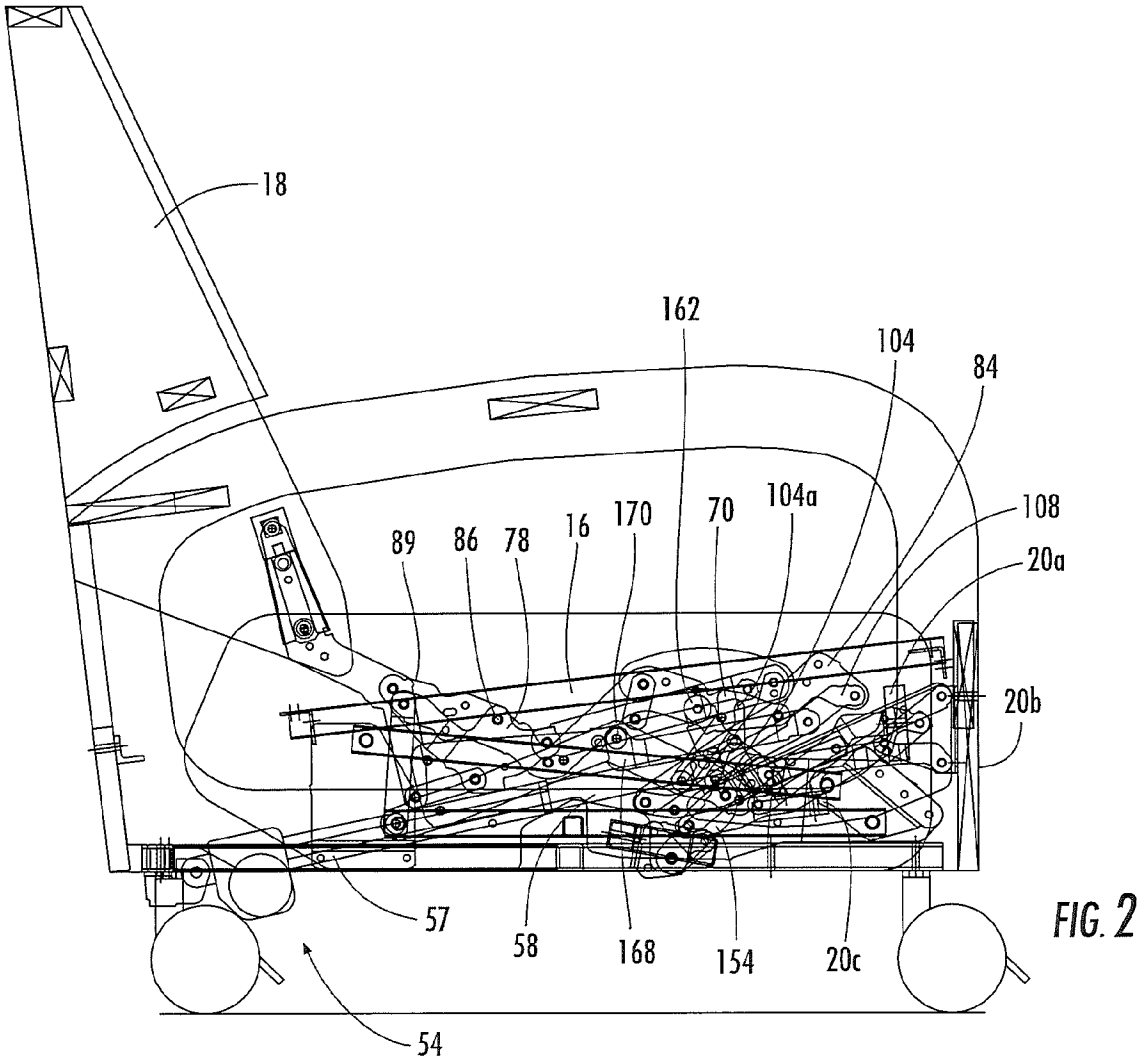
FIG. 2 is a cutaway side view of the chair of FIG. 1, with the chair in its upright position.
Figure 2A:
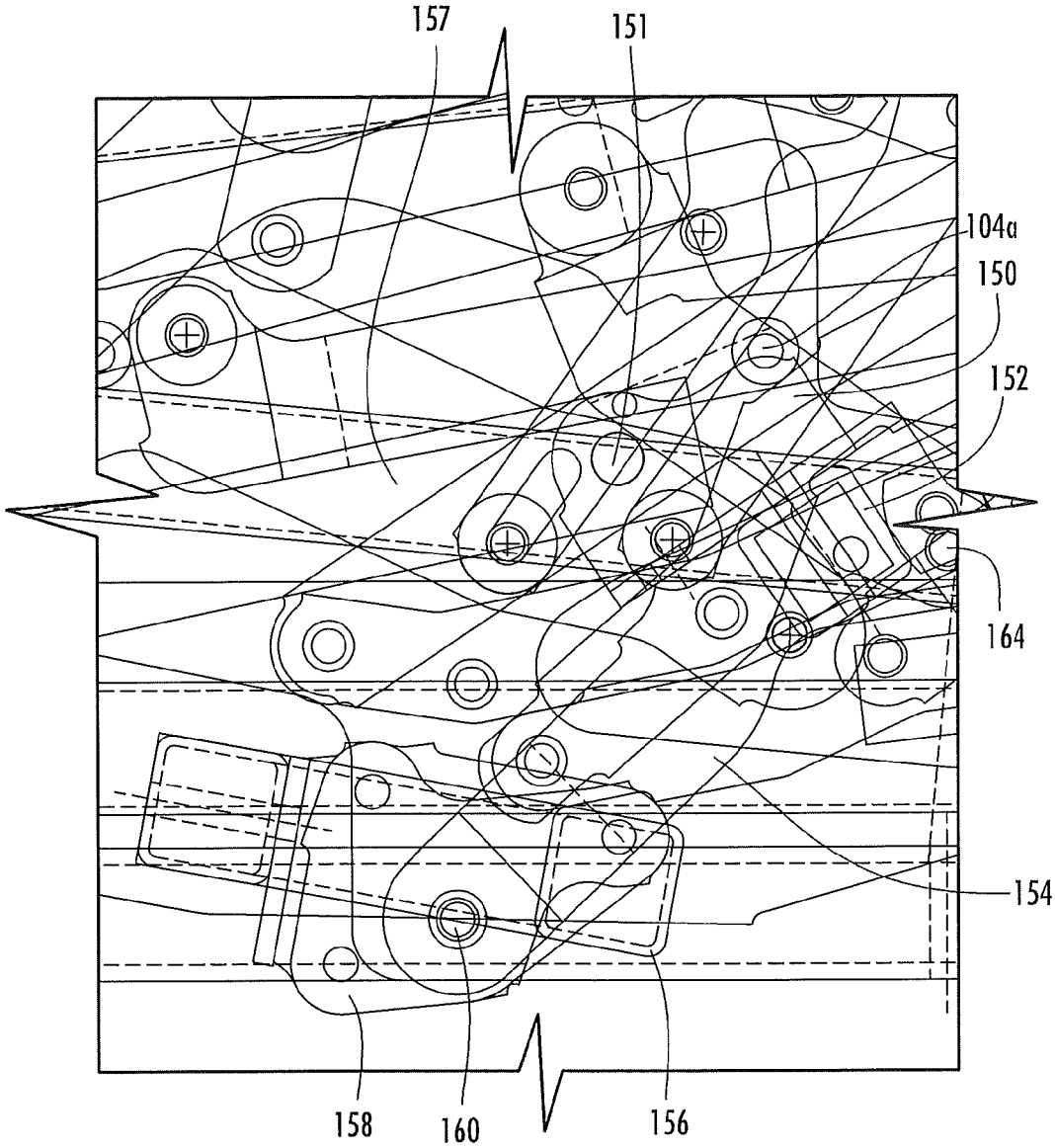

Operation of the chair typically begins in the upright position (FIG. 2). In the upright position, the ottomans 20*a*, 20*b*, 20*c* are all folded beneath the seat 16, with the main ottoman 20*b* positioned below the front of the seat 16 and vertically disposed, the rear ottoman 20*a* behind the main ottoman and vertically disposed, and the front ottoman 20*c* horizontally disposed and facing the underlying surface. The links comprising the portion of the reclining mechanism 21 that extends the ottoman (i.e., the front and rear ottoman drive links 108, 104, the front and rear ottoman extension links 118, 112, the front, main and rear ottoman brackets 128, 122, 138, the control link 132, and the bracing link 142) are folded beneath the seat 16 as a pantographic linkage. The seat 16 typically has a pitch angle of between about 5 and 8 degrees relative to horizontal, and the backrest 18 has a first backrest angle of between about 105 and 125 degrees relative to horizontal.

Still referring to FIG. 2, the rod 58 of the actuator unit 54 is partially retracted into the sleeve 57. The transition link 154 extends upwardly and forwardly from the pivot 160, and the tying link 162 extends upwardly and rearwardly from the pivot 164 to the pivot 166. As noted above, the seat 16 is slightly pitched so that the rear is lower than the front, and the backrest 18 is slightly inclined from bottom to top. The transition plate 80 is disposed so that the pivots 86, 89 are at generally the same elevation. The drive link 168 extends forwardly and slightly upwardly from the pivot 170.

Figure 3:
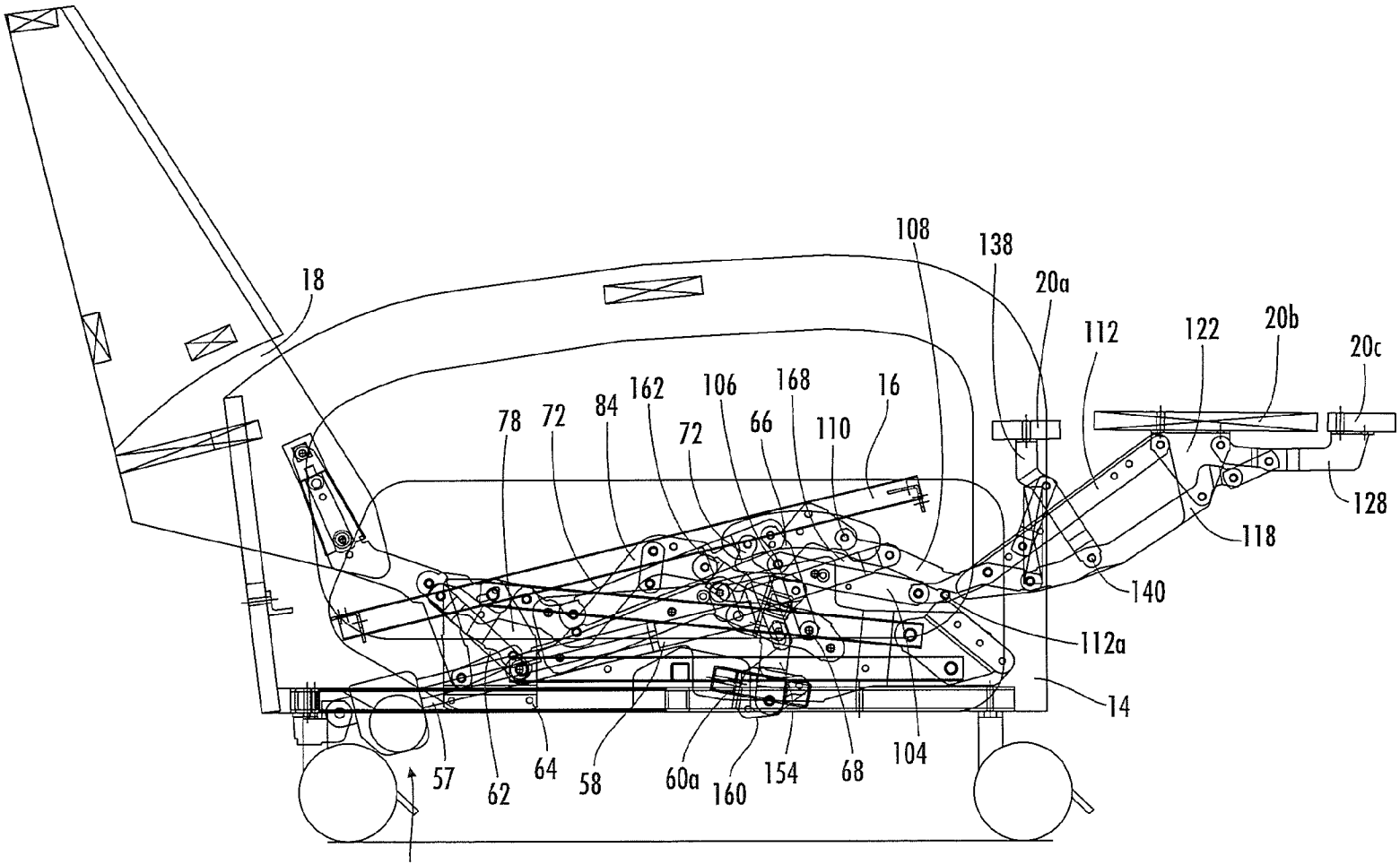
FIG. 3 is a cutaway side view of the chair of FIG. 1, with the chair in its TV position.
Figure 3A:
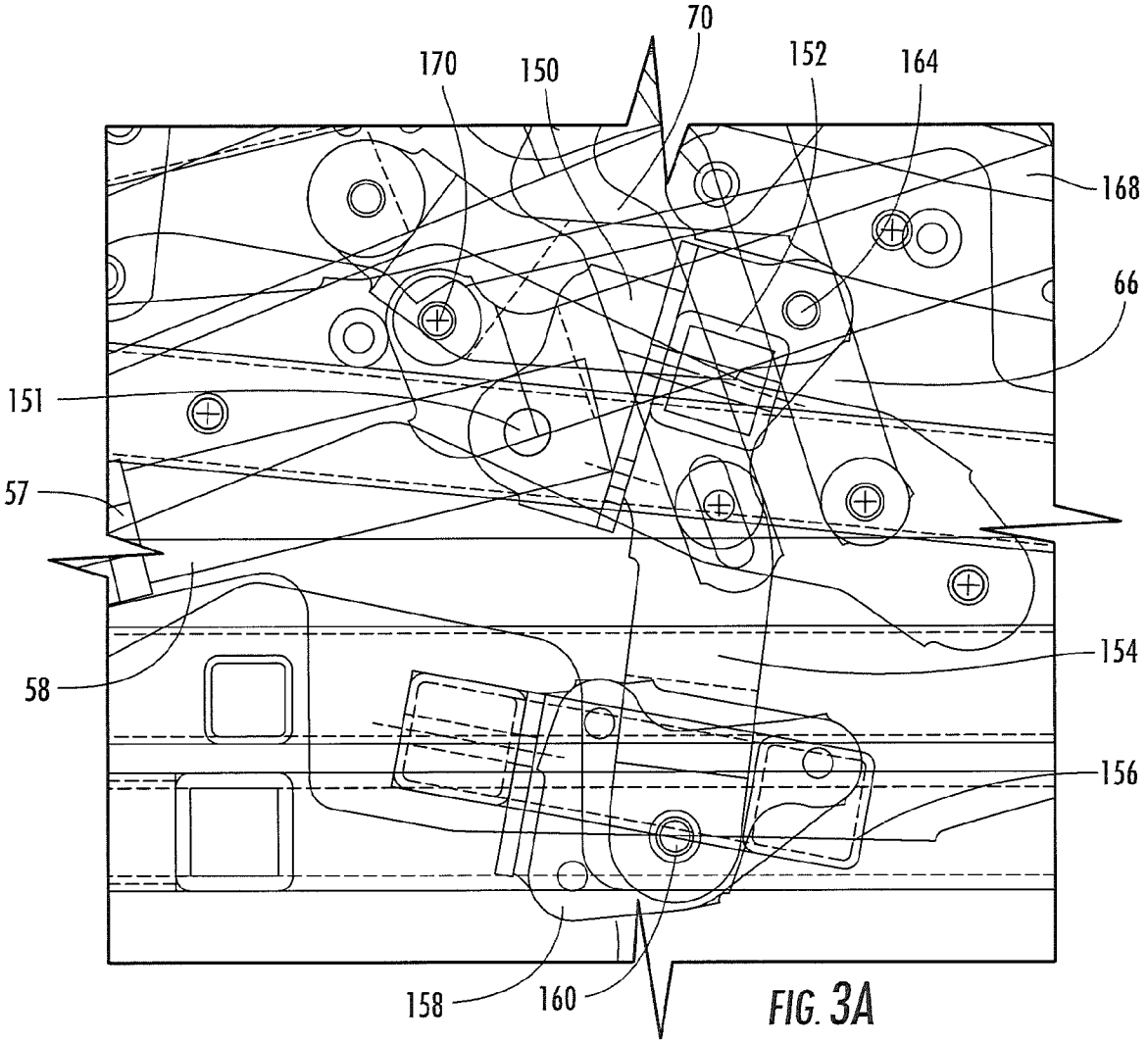

To move the chair 10 to the TV position of FIG. 3, the occupant actuates the actuator unit 54 (typically with a push button device or the like) that energizes the motor 56 and causes it to retract the rod 58 relative to the sleeve 57. Retraction of the rod 58 draws the transition link 154 counterclockwise (from the vantage point of FIG. 3) around the pivot 160. This rotation forces the tying link 162 rearwardly and slightly upwardly. The motion of the tying link 162 causes the seat panel 84, and in turn the seat 16, to move rearwardly relative to the frame 14 and to rotate slightly counterclockwise, such that the pitch in the seat 16 increases from its orientation in the upright position. As the seat 16 moves rearwardly, the drive link 168 rotates only slightly, with the net effect that the front ottoman drive link 108 rotates counterclockwise considerably about the pivot 110. This action also extends the front and rear ottoman extension links 118, 112, which in turn rotates the rear ottoman link 104 counterclockwise about the pivot 106. Relative separation of the front and rear ottoman extension links 118, 112 also rotates the main ottoman bracket 122 and the main ottoman 20*b* to a generally horizontal disposition in front of the seat 16. Extension of the front ottoman extension link 118 and rotation of the main ottoman bracket 122 also draws forward and inverts the front ottoman bracket 128 and the front ottoman 20*c*. Extension and separation of the front and rear ottoman extension links 118, 112 also forces the rear ottoman bracket 138 and the rear ottoman 20*a* upwardly and rotates the rear ottoman bracket about the pivot 140. Extension of the ottomans 20*a*, 20*b*, 20*c* ceases when the lower edge of the front ottoman drive link 108 strikes a stop pin 112*a* on the rear ottoman extension link 112.

Rearward movement of the seat 16 also forces the backrest 18 rearwardly relative to the frame 14 and rotates the backrest 18 very slightly counterclockwise. However, the backrest 18 substantially retains the first backrest angle between it and the seat 16 observed in the upright position of FIG. 2. In addition, rearward movement of the seat 16 draws the transition plate 78 rearward. This movement rotates the rear swing link 62 counterclockwise about the pivot 64 and draws the connecting link 72 rearwardly. As a result, the front swing link 66 and the sequencer link 70 rotate counterclockwise about their respective pivots 68, 60*a* (the sequencer link 70 also rises slightly relative to the pin 60*a* in its slot 70*a*, such that the pin 60*a* is in the center of the slot 70*a*).

To move the chair 10 to the fully reclined position of FIG. 4, the occupant again actuates the actuator 54 to further retract the rod 58 into the sleeve 57. This action rotates the transition link 154 further counterclockwise about the pivot 160, which in turn forces the tying link 162 upwardly and rotates it slightly clockwise relative to the transition link 154. The ascension of the tying link 162 forces the seat panel 84 and seat 16 upwardly and rearwardly. As the seat panel 84 rises, through the control link 98 it pulls the connecting link 72 upwardly and rotates it clockwise about the pivot 76. This movement draws the pivot 82 with the transition plate 78 upward; in response, the transition plate 78 rotates counterclockwise about the pivot 82. As the transition plate 78 rotates, it draws the drive link 92 upwardly and forwardly, which in turn forces the backpost 88 and the backrest 18 to rotate counterclockwise about the pivot 90 and move to a reclined position relative to the seat 16. Rotation ceases when an edge 78*a* of the transition plate 78 contacts a pin 84*a* on the seat panel 84. In this position, the backrest 18 typically reclines at a second backrest angle of between about 135 and 155 degrees relative to horizontal.

The chair 10 can be returned to the TV and/or upright position by actuating the actuator 54 to do so. As the rod 58 extends from the sleeve 57, the chair 10 reverses the sequence described above.

The chair 10 can be moved from the upright position of FIG. 2 to the lift position of FIG. 5 by actuating the actuator 54 to extend the rod 58 from the sleeve 57. In the upright position, a pin 104*a* rests against the rear edge of the front ottoman drive link 108, thereby preventing the reclining mechanism 21 from collapsing any further than it does in the upright position. Extension of the rod 58 from the sleeve 57 presses upwardly on the transition link 154; however, because the reclining mechanism 21 is prevented from further movement, the result is an upward force on the frame 14. Because the frame 14 is free to rise from the base 12, it does so, with its movement controlled by the front and rear lift links 32, 36 as they rotate counterclockwise about, respectively, pivots 34, 38. The frame 14 rises above the base 12 and rotates slightly clockwise; typically, the rear of the frame 14 rises between about 19 and 23 inches, and the frame 14 rotates between about 21 and 26 degrees relative to horizontal.

In the lift position, the backrest 18 typically has an angle relative to horizontal of between about 81 and 101 degrees. As such, the lowermost portion of the backrest 18 has moved substantially directly vertically from its position in the upright position; for example, the lowermost portion of the backrest 18 may move only 0 to 1.25 inches forward relative to the base 12. Also, the seat 16 typically moves such that the rearmost edge thereof moves between about 0.25 and 1.25 inches forwardly, and the pitch angle of the seat is between about 13 and 21 degrees relative to horizontal. This movement of the backrest 18 and/or seat 16 can provide the occupant with a more secure sensation as the chair 10 lifts; it does not produce a sensation of the occupant being "thrown" from the chair, as can be the case with other lift chairs.

Also, with reclining and lift mechanisms of this configuration, the chair can take many different styles, including off-the-floor and high leg styles that are typically difficult to employ with reclining lift chairs.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention.

That which is claimed is:

1. A seating unit, comprising:

a base;

a frame with arms on opposing sides;

a seat;

a backrest;

at least one ottoman;

a reclining mechanism that interconnects the frame, the seat, the backrest, and the at least one ottoman, the reclining mechanism comprising a series of pivotally interconnected links and configured to move the seating unit between (a) an upright position, in which the backrest is generally upright and defines a first backrest angle relative to horizontal, the seat is generally horizontal, and the at least one ottoman is retracted below the seat, (b) a TV position, in which the backrest substantially maintains the first backrest angle, and the at least one ottoman is extended in front of the seat, and (c) a fully reclined position, in the at least one ottoman remains extended on front of the seat, and the backrest defines a second backrest angle relative to horizontal that is shallower than the first backrest angle;

a lift mechanism interconnecting the base and the frame and configured to move the seating unit between the upright position and a lift position, in which both the frame and the seat are raised and tilted forward from their respective positions in the upright position, and the backrest defines a third backrest angle relative to horizontal that is greater than the first backrest angle;

a power unit interconnected with the reclining mechanism and the lift mechanism, the power unit configured to move the seating unit between the lift, upright, TV and fully reclined positions, the power unit configured to extend to move the seating unit from the upright position to the lift position and to retract to move the seating unit from the upright position to the TV position;

wherein a lowermost portion of the backrest moves substantially directly vertically when moving from the upright position to the lift position.

2. The seating unit defined in claim 1, wherein the lift mechanism includes front and rear lift links pivotally interconnected with the base and with the frame.

3. The seating unit defined in claim 2, wherein the power unit is pivotally interconnected with the base and the reclining mechanism.

4. The seating unit defined in claim 3, wherein the power unit is pivotally connected to the base rearwardly of the rear lift link.

5. The seating unit defined in claim 3, wherein the power unit is pivotally interconnected with the reclining mechanism rearwardly of a pivot between the rear lift link and the frame.

6. The seating unit defined in claim 1, wherein, in the upright, TV and fully reclined positions, the frame rests on the base.

7. The seating unit defined in claim 1, wherein the reclining mechanism includes a drive linkage, the drive linkage comprising a transition member that is pivotally attached to the power unit and to the frame, and a tying link that is pivotally attached to the transition member and to the seat.

8. The seating unit defined in claim 1, wherein a rearmost portion of the seat rises between about 17 and 20 inches in moving from the upright position to the lift position.

9. The seating unit defined in claim 1, wherein the seat defines a first seat angle in the upright position and a second seat angle in the lift position, and wherein the difference between the first and second seat angles is between about 21 and 26 degrees.

10. The seating unit defined in claim 1, wherein in moving between the upright and TV positions, the seat moves relative to the frame.

11. The seating unit defined in claim 1, wherein the power unit comprises a motor, a sleeve, and a rod that retracts within and extends from the sleeve, and wherein the rod extends from the sleeve when the seating unit is in the lift position.

12. A seating unit, comprising:

a base;

a frame with arms on opposing sides;

a seat;

a backrest;

at least one ottoman;

a reclining mechanism that interconnects the frame, the seat, the backrest, and the at least one ottoman, the reclining mechanism comprising a series of pivotally interconnected links and configured to move the seating unit between (a) an upright position, in which the backrest is generally upright and defines a first backrest angle relative to horizontal, the seat is generally horizontal, and the at least one ottoman is retracted below the seat, (b) a TV position, in which the backrest substantially maintains the first backrest angle, and the at least one ottoman is extended in front of the seat, and (c) a fully reclined position, in the at least one ottoman remains extended on front of the seat, and the backrest defines a second backrest angle relative to horizontal that is shallower than the first backrest angle;

a lift mechanism interconnecting the base and the frame and configured to move the seating unit between the upright position and a lift position, in which both the frame and the seat are raised and tilted forward from their respective positions in the upright position, and the backrest defines a third backrest angle relative to horizontal that is greater than the first backrest angle;

a power unit interconnected with the reclining mechanism and the lift mechanism, the power unit configured to move the seating unit between the lift, upright, TV and fully reclined positions, the power unit configured to extend to move the seating unit from the upright position to the lift position and to retract to move the seating unit from the upright position to the TV position;

wherein the seat defines a first seat angle in the upright position and a second seat angle in the lift position, and wherein the difference between the first and second seat angles is between about 21 and 26 degrees; and wherein a rearmost portion of the seat rises between about 17 and 20 inches in moving from the upright position to the lift position.

13. The seating unit defined in claim 12, wherein the power unit is configured to extend to move the seating unit from the upright position to the lift position and to retract to move the seating unit from the upright position to the TV position.

14. A seating unit, comprising:

a base;

a frame with arms on opposing sides;

a seat;

a backrest;

at least one ottoman;

a reclining mechanism that interconnects the frame, the seat, the backrest, and the at least one ottoman, the reclining mechanism comprising a series of pivotally interconnected links and configured to move the seating unit between (a) an upright position, in which the backrest is generally upright and defines a first backrest angle relative to horizontal, the seat is generally horizontal, and the at least one ottoman is retracted below the seat, (b) a TV position, in which the backrest substantially maintains the first backrest angle, and the at least one ottoman is extended in front of the seat, and (c) a fully reclined position, in the at least one ottoman remains extended on front of the seat, and the backrest defines a second backrest angle relative to horizontal that is shallower than the first backrest angle;

a lift mechanism interconnecting the base and the frame and configured to move the seating unit between the upright position and a lift position, in which both the frame and the seat are raised and tilted forward from their respective positions in the upright position, and the backrest defines a third backrest angle relative to horizontal that is greater than the first backrest angle;

a power unit interconnected with the reclining mechanism and the lift mechanism, the power unit configured to move the seating unit between the lift, upright, TV and fully reclined positions;

wherein a lowermost portion of the backrest moves substantially directly vertically when moving from the upright position to the lift position; and wherein the lift mechanism includes front and rear lift links pivotally interconnected with the base and with the frame; and wherein each of the arms includes an internal cavity, and wherein the front and rear lift links are located within the arm cavities.

15. The seating unit defined in claim 14, wherein each of the arms includes an inner panel, and wherein the reclining mechanism is mounted to an inboard surface of the inner panel.

* * * * *